United States Patent [19]

Nenkov et al.

[11] Patent Number: 4,664,204

[45] Date of Patent: May 12, 1987

[54] FIXING MECHANISM FOR A WIRELINE CORE BARREL OF CORE DRILLING EQUIPMENT

[75] Inventors: Nikolay D. Nenkov, Sofia; Ivan B. Petrov, Assenovgrad; Stoyko P. Peev, Plovdiv, all of Bulgaria

[73] Assignee: Vish Minno-Geolojki Institute, Sofia, Bulgaria

[21] Appl. No.: 741,556

[22] Filed: Jun. 5, 1985

[51] Int. Cl.[4] ..... E21B 25/06

[52] U.S. Cl. ..... 175/44; 175/246

[58] Field of Search ..... 175/246, 44

[56] References Cited

U.S. PATENT DOCUMENTS

| | | | |
|---|---|---|---|
| 3,225,845 | 12/1965 | Koontz et al. | 175/246 |
| 3,266,835 | 8/1966 | Hall et al. | 175/246 |
| 3,977,482 | 8/1976 | Reed et al. | 175/246 |
| 3,986,555 | 10/1976 | Robertson | 175/246 |
| 4,558,749 | 12/1985 | Fulkerson | 175/246 |

FOREIGN PATENT DOCUMENTS

| | | | |
|---|---|---|---|
| 254455 | 12/1963 | Australia | 175/246 |

*Primary Examiner*—Stephen J. Novosad
*Assistant Examiner*—Bruce M. Kisliuk

[57] ABSTRACT

Wireline core barrel fixing mechanism incorporating a fixer which prevents any wireline core barrel deformations, fixes the wireline core barrel to the hollow drill bit, and signals any drilling process interruptions. The wireline core barrel fixer comprises a cylindrical hollow body adapted to be mounted within the drill bit and incorporating selectively operated rollers for locking the hollow body to the drill, the rollers being mounted in planes parallel to each other and perpendicular to the geometrical axis of the cylindrical hollow body. The upper end of the fixer is connected to a cap, in the lower part of which opposite longitudinal slots are cut. The fixer is mounted inside a cylindrical hollow body, the upper end of which is connected to the stopper bar and in its lower part a locking bar and a set nut are mounted, connected to the fixer. The lower end of the cylindrical hollow body is threaded, and on the thread a longitudinally extending extensible and compressible spring body is fastened, the lower end of the spring body gripping a signal stem. On the end of signal stem there is mounted a sealing ring, and under it there is mounted a bearing assembly carrying a core-receiving and gripping barrel. The entire assembly of cap, hollow body, slit spring body, and core barrrel carrying a drill core is selectively pulled up out of the hollow drill pipe string by means of a wire or rope attached to the cap.

4 Claims, 3 Drawing Figures

FIXING MECHANISM FOR A WIRELINE CORE BARREL OF CORE DRILLING EQUIPMENT

This invention relates to a fixing mechanism for the wireline core barrel of earth drilling equipment which produces a core. Such equipment makes it possible to remove a core from the drill barrel without pulling up the string of drill rods. Core drilling equipment of such general type is disclosed in Soinski et al U.S. Pat. No. 4,466,497, and in *Bulletin* 3200B, entitled "Longyear World No. 2" published by E. J. Longyear Company, Minneapolis, Minn.

One known type of combined fixing mechanism, disclosed in Bulgarian Pat. No. 50,941, consists of a body incorporating two rollers, placed in two planes, which are parallel to each other and perpendicular to the geometrical axis of the fixing mechanism, the central fixer being provided with a rotative shape coaxially mounted in the body. On its stem there are a spiral spring, a fixing bushing, and a thrust washer fastened between two nuts.

A disadvantage of this type of fixing mechanism is that the core barrel is subject to deformations when the drill bit is being retracted; further, the fixing mechanism fixes only the core barrel.

The present invention has among its objects the provision of a wireline core barrel fixing mechanism which prevents any wireline core barrel deformations, fixes the wireline core barrel to the drill bit, and signals any drilling process interruptions.

These objects are achieved by means of a fixing mechanism in accordance with the present invention. Such mechanism comprises a cap, in the lower section of which there are two opposite longitudinally slots receiving the opposite ends of a transverse cylindrical pin, by means of which the fixing mechanism is joined to the upper end of the fixer. The fixer is in the form of multi-sectional cylindrical hollow body. In a first section in the upper part of the fixer, there are two oppositely disposed lugs, the width of which is equal to that of the lower section of a cap. The second and third sections of the fixer are disposed in the middle part thereof, and are separated by a ring-shaped groove. The lower part of the third section is threaded, and by means of the thread is connected to a set nut and a locking bar. The set nut is mounted in the lower part of a cylindrical hollow body or casing whose upper part accommodates the second and third sections of the fixer.

The upper part of the cylindrical hollow body is threaded, by means of which it is fastened to a stopper bar, and in two planes, parallel to each other and perpendicular to the geometrical axis of the hollow body, rollers are mounted; such rollers are held in position by support springs. The lower end of the cylindrical hollow body is threaded, by means of which it is connected to a slit spring body, in the upper part of which the locking bar is mounted. The slit spring body consists of a upper part, delimited by a choke orifice, in which there is formed a retention rim, the middle part is a slit spring, and the lower part, which is connected with a signal rod sealed with a ring and an underlying body assembly, is clamped by a cover nut.

The bearing body houses an axial bearing and bushings, which carry the bearing stem, the upper end of which is theaded to be connected to nuts clamping thrust washers, and the lower part thereof has a drain orifice and an attachment thread for the core barrel.

The advantages of the invention are to the effect that a normal functioning and core barrel preservation are achieved due to the fact that a joint assembly makes the system made up of the wireline, that overshot, and the core barrel more flexible just above the core barrel; this protects the core barrel from bending, ensures the fixing of the core barrel, and signals any interruptions of the drilling process.

The invention will be more readily understood upon consideration of the accompanying drawings, in which.

Figure 1:
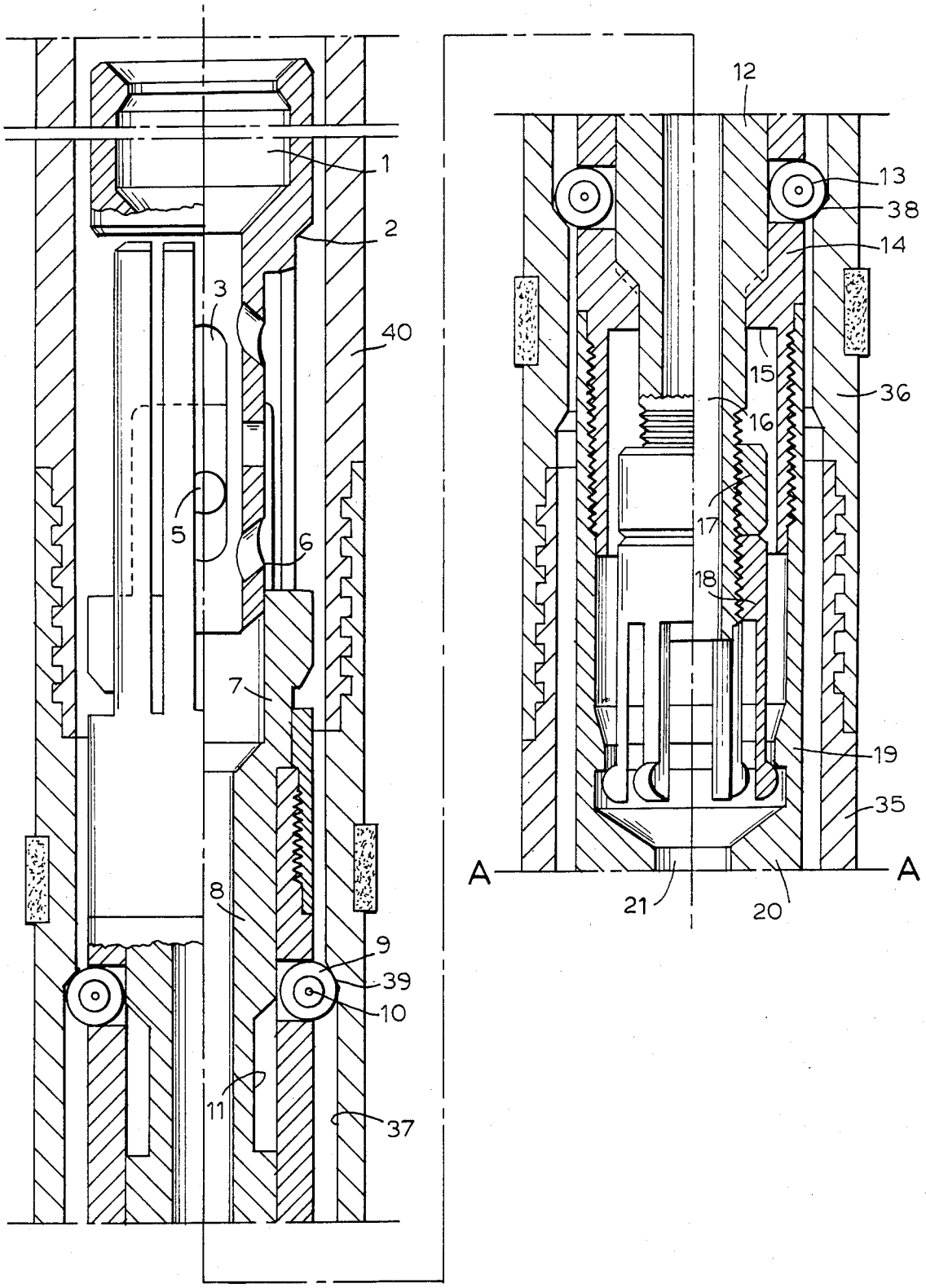
FIG. 1 is a view partially in longitudinal axial section and partially in side elevation of a well drilling string and the upper part of a wireline core barrel fixing mechanism therein according to the invention.
Figure 2:
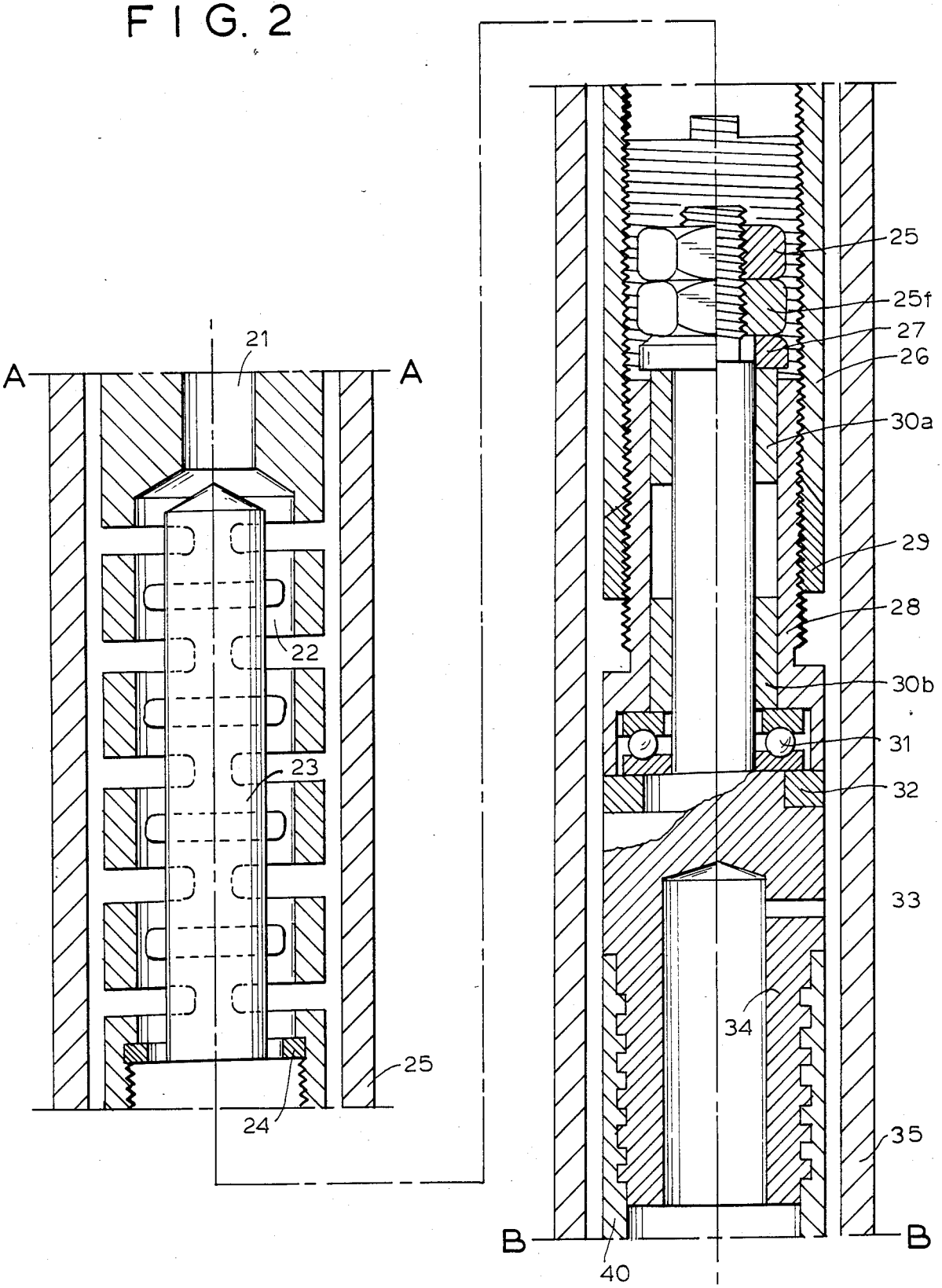
FIG. 2 is a view partially in longitudinal axial section and partially in side elevation of an intermediate portion of a well drilling string and the lower end of a wireline core barrel fixing mechanism according to the invention.
Figure 3:
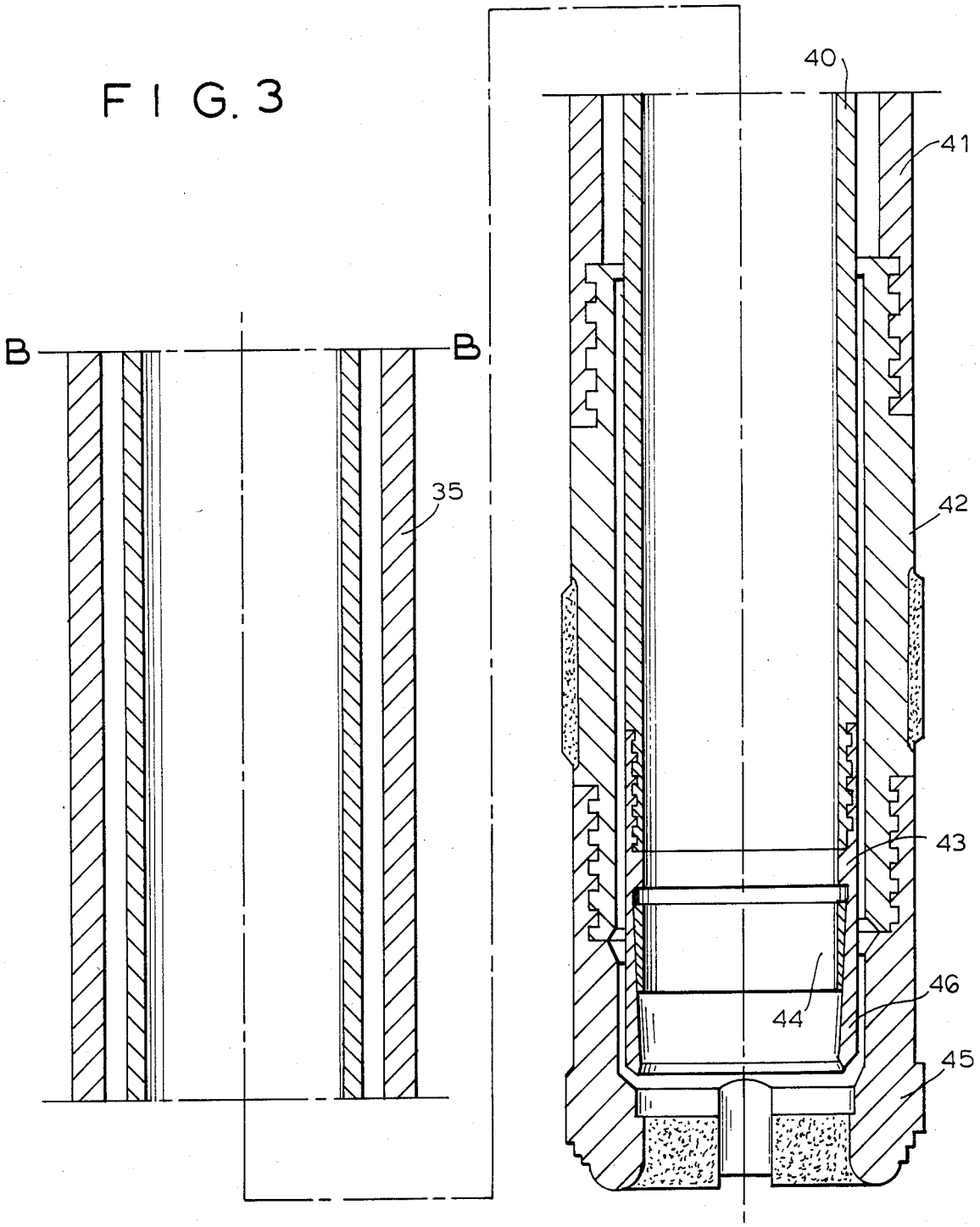
FIG. 3 is a view in longitudinal axial section through the lower end of a well drilling string and a wireline core barrel therein.

As indicated, FIG. 1 is adapted to be mounted with its lower end, designated A—A, coincident with the upper end of FIG. 2, which was likewise designated A—A, with the axis C—C of FIG. 1 aligned with the axis C—C of FIG. 2. FIG. 3 is adapted to be mounted with its upper end designated B—B coincident with the lower end of FIG. 2, likewise designated B—B The illustrative preferred embodiment of fixing mechanism according to the invention comprises a cap 1, the inner and outer surfaces of which are bisectionally shaped, the upper outer section of the cap 1 being separated from the lower section thereof by a groove 2. In the lower section of cap 1 two opposite longitudinally slots 3 are cut, slots 3 receiving the opposite ends of a transverse cylindrical pin 5 by means of which the cap is connected with the upper end of fixer 7, which a cylindrical hollow body. In inner surface of fixer 7 is bisectionally shaped with a wider upper part gradually narrowing into a channel 16, and an outer surface, which is also multisectionally shaped. The section of the upper part of fixer 7 has two oppositely disposed lugs 6, the distance between lug 6 being equal to the width of the lower section of cap 1. The second section 8 and the third section 12 of fixer 7 are equal in diameter, such diameter being smaller than the diameter of the first section. The second and third sections of fixer 7 are separated by a ring-shaped groove 11, the diameter of which is smaller than that of the second section 8 and the third section 12 of the fixer 7.

The lowest section of fixer 7 is threaded and concentrically gripped by a locking bar 18 and lock nut 17, both mounted in the lower part of a cylindrical hollow body 14. Such lower part of the hollow body 14 is delimited by the limiter section 15, above which in upper part of the cylindrical hollow body 14 there are mounted sections 8 and 12 of fixer 7. Rollers 9 and 13, supported by spring 10, are mounted in recesses provided in the upper part of the cylindrical hollow body 14 in two planes, one above the other and perpendicular to the geometrical axis of the body 14. The lower end of the cylindrical hollow body 14 is threaded, and on such thread the lower end of stopper bar 4 is fastened; the upper, operational end of stopper bar 4, is inserted in groove 2 of cap 1.

The outer surface of the cylindrical hollow body 14 is smooth, and the threaded lower part thereof is connected with a longitudinally extending slit spring body 20, in the upper end of which there is mounted a locking bar 18. The slit spring body 20 is cylindrical, with a smooth outer surface, and consists of an internally threaded upper part with a retention rim 19 under it, and a choke orifice 21; the middle of slit spring body 20 is slit spring 22 which is transversely slit at a plurality of longitudinally spaced location, and the lower cylindrical part 26 thereof is provided with an internal thread which fastens a signal bar 23. Signal bar 23 is sealed with a resilient O-ring 24, a bearing assembly 28 being clamped a cover or set nut 29. A recess is formed in the lower part of the bearing assembly 28, such recess accommodating an axially bearing 31 sealed with an O-ring 32 and the longer its longitudinal geometric axis there is an opening housing two bearing bushings 30 in which a bearing stem 34 is inserted. The upper part of bearing stem 34 is cylindrical and it ends with a thread, on which nuts 25 are threaded, such nuts clamping a thrust washer 27. The lower part of bearing stem 34 has a drain orifice 33, and has an external bearing thread for supporting a core barrel 40, shown in detail in FIG. 3.

The wireline core barrel 40 is disposed coaxially within the lower end 41 of the drill pipe 35. Core barrel 40 has a cap 43 screwed onto its lower end, the cap supporting a core spring shoe 46 containing a core spring 44.

The wireline core barrel fixing mechanism of the invention is designed for three basic functional positions—transportational, when lowering the core barrel into the bore hole, operational, and again transportational, when the core barrel is being retracted from the drilled pipe string.

The fixing mechanism for a wireline core barrel of core drilling equipment according to the invention operates as follows:

The setting of the fixing mechanism in transportational position when the core barrel is being lowered into the bore hole, is carried out as follows:

The core barrel 40 is inserted into the drill pipe string 35 made up of serially connected drill pipe sections, the lower end 41 of the drill pipe being connected through an expander 42 to a diamond drilling crown 45. Cap 1 is pulled up, thus releasing it from stopper bar 4; along with it fixer 7 is also released by means of the cylindrical pin 5, and the second section 8 and the third section 12 of fixer 7 come into position over the rows of rollers 9 and 13. There upon the rollers 9 and 13 recede inwardly—the rollers in the upper row thereof recede into ring-shaped groove 11 and the rollers in the lower rows thereof recede into the space left vacant by the third section 12. Simultaneously, locking bar 18 comes over retention rim 19. Cap 1 is then wedged by its own weight into the upper part of fixer 7. Thus the fixing mechanism is ready for lowering into the bore hole, either by gravitation or by the pressurized drilling fluid. During the lowering operation, rollers 9 and 13 cannot be pushed out of the body 14 because of the appropriately drill pipe string inner diameter. During the whole lowering operation, however, the third section 12 of the fixer 7 presses against the lower row of rollers 13.

In case the lowering is carried out in a bore hole with water losses (hidden circulation) then an overshot, set in the appropriate mode, is used. The overshot is attached to the lower end of a wire which is lowered into the bore hole, and is adapted to be fastened to cap 1, which is connected with the stopper bar 4 after pulling up fixer 7, and then the whole system is put into the lower-ready core barrel (not shown). After the wireline core barrel is set up in operational position, the overshot is automatic self-released, and the wire carrying the overshot is automatically pulled.

Setting the fixing mechanism in operational position is carried out automatically. After reaching the widened ring-shaped section of the lower end of the drill pipe string, the third section 12 of the fixer 7 pushes out the lower row of rollers 13, descends, and locks them into position. The downward motion of the wireline core barrel continues until the lower row of rollers 13 reaches the lower end or flange 38 of the ring-shaped groove 37. The core barrel itself discontinues its motion, but fixer 7 is further advanced by its accumulated kinetic force and the second section 8 of the fixer 7 pushes the upper row of rollers 9 out of the cylindrical hollow body 14 and locks them in position against the upper end or flange of the ring-shaped groove 37. Simultaneously, locking bar 18 passes through retention rim 19 of the slit spring body 20 and stops the upward advance of the fixer 7. Thus the wireline core barrel is now in its operation position.

During operation, when the core barrel fills out with core or when the entered core becomes stuck in the core barrel, the core barrel discontinues its forward or downward motion and lags behind the drill pipe string. As a result, the slit spring 22 is compressed, and signal stem 23 closes choke orifice 21, thus causing a sharp rise in the pressure of the drilling fluid. This is a signal that the drilling operation is completed, and the wireline core barrel is then to be drawn out.

Upon core rupture, caused by tensile strain of the drill pipe string, the core barrel stretches slit spring 22 by means of bearing stem 34 and bearing body 28. As a result, the slit spring 22 lengthens, and the end of the core barrel 40 touches on the rock bit 45 attached to the lower end of the dill pipe section 35, and the tensile strain on the core barrel is eased.

The setting of the wireline core barrel fixing mechanism in its second transportation position is carried out by dropping down an overshot with a rope wire, the overshot then gripping cap 1 and the rope or wire then pulling cap 1 upwardly. This movement of cap 1 positions the second section 8 and the third section 12 of fixer 7 over the two rows of rollers 9 and 13. The lower row of rollers 13 then can recede into the cylindrical hollow body 14. Simultaneously, locking bar 18 is positioned over retention rim 19, thus releasing the wireline core barrel. After the parts reach the surface of the earth, the joint consisting of cap 1, pin 5, and fixer 7 makes it possible to easily detach the core barrel from the drill pipe strain.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. Wireline mechanism for removing a core barrel containing a core from within a hollow drill string carrying a hollow drill crown cutter on its lower end while the drill string is in position in the earth, said mechanism comprising a cylindrical fixer adapted to be mounted within the drill string coaxially thereof, a cap for attachment to a flexible elongated core-removing member secured to the upper end of the fixer, a cylindrical hollow body adapted to be mounted within the drill string coaxially thereof and generally below the fixer, a lower portion of the fixer being adapted to be telescoped within the upper portion of the cylindrical hollow body, a longitudinally extending stopper bar connected to the upper part of the cylindrical hollow body, a locking bar and a nut connecting the fixer to the lower part of the cylindrical hollow body, to the lower end of the cylindrical hollow body there being attached the upper end of an extensible and compressible spring body, an upwardly extending signal stem having its lower end attached to the lower end of the spring body, the upper end of the signal stem functioning as a movable valve elements which cooperates with a valve seat at the lower end of an axial choke orifice through the upper end of the spring body, an axially extending bearing assembly including a bearing stem connected to the lower end of the spring body, and a core-receiving barrel connected to the lower end of the bearing stem for receiving the upper end of a core produced by the hollow drill crown cutter on the lower end of the hollow drill string.

2. Wireline mechanism according to claim 1, wherein the extensible and compressible spring body extends longitudinally and is transversely slit at a plurality of longitudinally spaced locations.

3. Wireline mechanism for removing a core barrel containing a core from within a hollow drill string according to claim 1, wherein the fixer is formed as a multi-sectional cylindrical hollow body, an inner surface of which has two parts of different diameter, a first section, in an upper part of the fixer, being wider than sections in a lower part of the fixer, the upper part gradually narrowing into a channel, an outer surface of the fixer also having a multi-sectionally shaped outer surface, two oppositely disposed lugs in the first section, on the upper part of the fixer, the distance between the lugs being equal to the width of the lower part of the cap, a second section and a third section of the fixer, being on the lower part of the fixer, having equal outer diameters being separated by a ring-shaped groove, the diameter of the groove being smaller than the diameter of each of the second and third sections on the lower part of the fixer.

4. Wireline mechanism for removing a core barrel containing a core from within a hollow drill string according to claim 1, wherein the bearing assembly comprises a bearing body, an axial bearing mounted in the bearing body, beneath the axial bearing there being a sealing O-ring, and along the axis of the bearing there being provided a channel in which bearing bushings are mounted, the bearing bushings holding a bearing stem, the bearing stem having an upper part which is cylindrical and has a thread, and nuts are mounted on said threaded part of said bearing stem, the nuts resting upon a thrust washer, a lower part of the bearing assembly having a drain orifice with an external bearing thread, with which the bearing assembly engages with the upper end of the core-receiving barrel.

* * * * *